United States Patent [19]

Oleborg

[11] 4,297,964

[45] Nov. 3, 1981

[54] MOBILE CAISSON STRUCTURE

[75] Inventor: Said Oleborg, Onsala, Sweden

[73] Assignee: Navire Cargo Gear International AB, Göteborg, Sweden

[21] Appl. No.: 136,902

[22] Filed: Apr. 3, 1980

[30] Foreign Application Priority Data

Apr. 18, 1979 [SE] Sweden ..... 7903371

[51] Int. Cl.[3] ..... B63B 21/00

[52] U.S. Cl. ..... 114/263; 14/71.1

[58] Field of Search ..... 114/263, 258, 262, 45, 114/48, 264, 270; 14/27–29, 69.5, 71.3, 71.1; 405/1, 3

[56] References Cited

U.S. PATENT DOCUMENTS

| | | | |
|---|---|---|---|
| 3,683,838 | 8/1972 | Godbersen | 114/263 |
| 3,875,603 | 4/1975 | Mampaey | 14/71.3 |
| 4,111,145 | 9/1978 | Ohsaka | 14/71.3 |

FOREIGN PATENT DOCUMENTS

| | | | |
|---|---|---|---|
| 353257 | 7/1931 | United Kingdom | 14/71.1 |

*Primary Examiner*—Trygve M. Blix
*Assistant Examiner*—Jesus D. Sotelo
*Attorney, Agent, or Firm*—Cantor and Singer

[57] ABSTRACT

A caisson structure facilitating communication between a ship and a quay comprises a displacement unit having ballasting members, and a first housing located at one end of the displacement structure and having sufficient height to reach above high tide water level, even when the displacement unit rests upon the harbor bottom. This housing has a platform, from which a ramp extends at least to a second housing at the opposite end of the displacement unit. The second housing comprises machinery for raising and lowering the adjacent end of the ramp, as this is required to facilitate access to the ship with changing tide water levels.

3 Claims, 4 Drawing Figures

MOBILE CAISSON STRUCTURE

BACKGROUND OF THE INVENTION

Variations in the tide water level cause considerable problems in many ports, especially when Ro-Ro ships are involved. Even if the ship is provided with a communication ramp of its own, this cannot, alone, ensure uninterrupted traffic between the ship and the quay at all times.

It has been proposed to use a pontoon as an intermediary between the ship and the quay. The pontoon is provided with a ramp, whereby it is possible to distribute the difference in level between the ship and the quay upon two ramps.

The mooring of these pontoons is, however, difficult, and heeling movements at the pontoon cannot be fully avoided, when a heavy vehicle suddenly approaches, or leaves the pontoon.

The aim of the present invention is to propose a mobile caisson structure, which offers the same possibilities as a pontoon, concerning communication between the ship and the quay, but which is not liable to suffer from external actions of the kind making a pontoon unsuitable.

SUMMARY OF THE INVENTION

A caisson according to the invention is characterized in at least one displacement unit having ballast tanks, a first housing at one end of the displacement unit, said housing having sufficient height to extend above high water level at the location where the caisson is to be used and with its displacement unit resting upon the bottom, said housing having a platform located above said high water level, a second housing comprising two towers at the opposite end of said displacement unit, and a communication ramp having one end supported by the platform of the first housing, and extending at least to said other housing, which is provided with means for raising and lowering the adjacent end of the communication ramp.

The displacement unit preferably comprises two parallel displacement bodies, which are spaced apart a distance at least corresponding to the breadth of the communication ramp, and which are interconnected by the two housings.

The communication ramp preferably extends past the second housing with a portion being noticeably broader than at its extension between the two housings.

DESCRIPTION OF A PREFERRED EMBODIMENT

Figure 1:
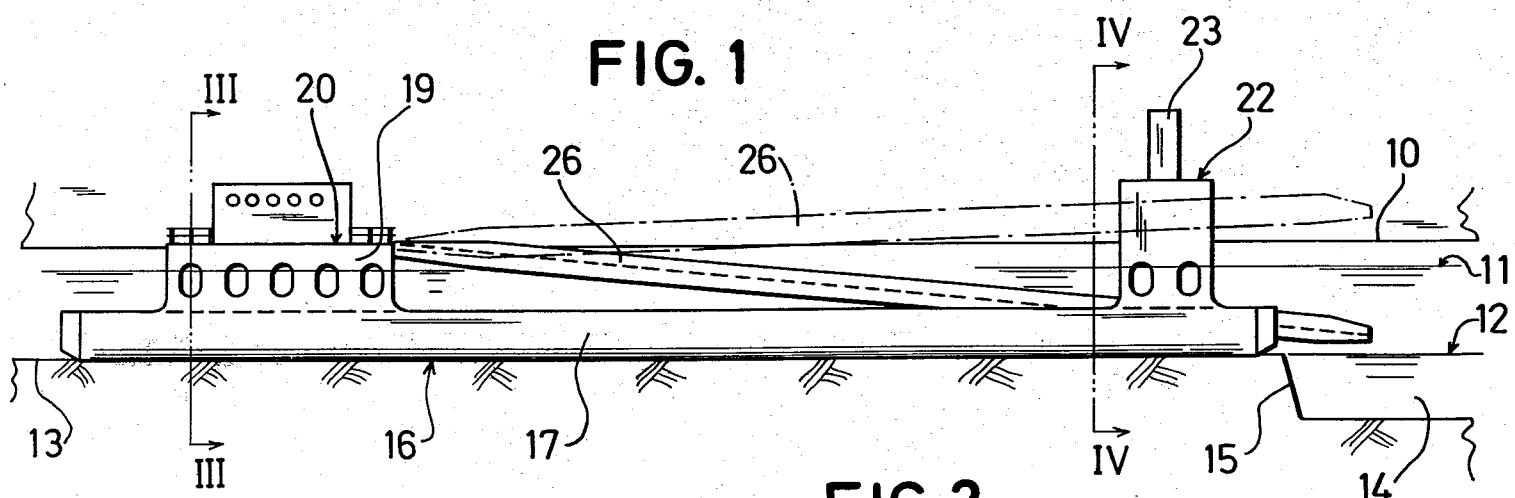
FIG. 1 shows a side view of a caisson structure according to the invention.
Figure 2:
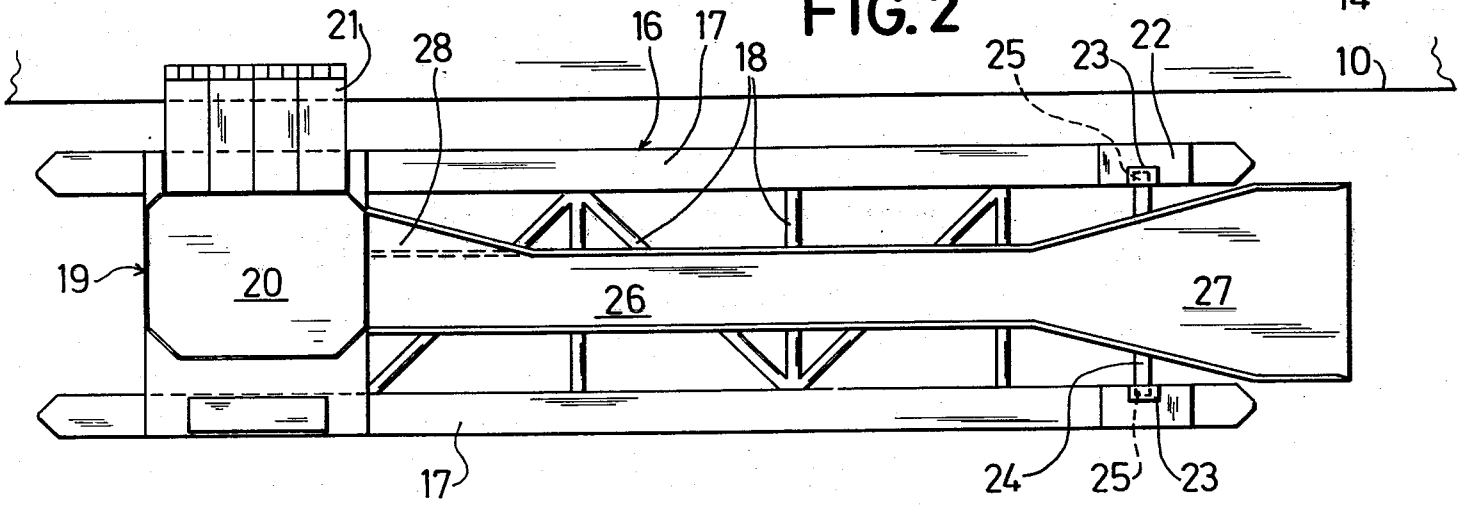
FIG. 2 shows a view of the caisson structure as viewed from above.
Figure 3:
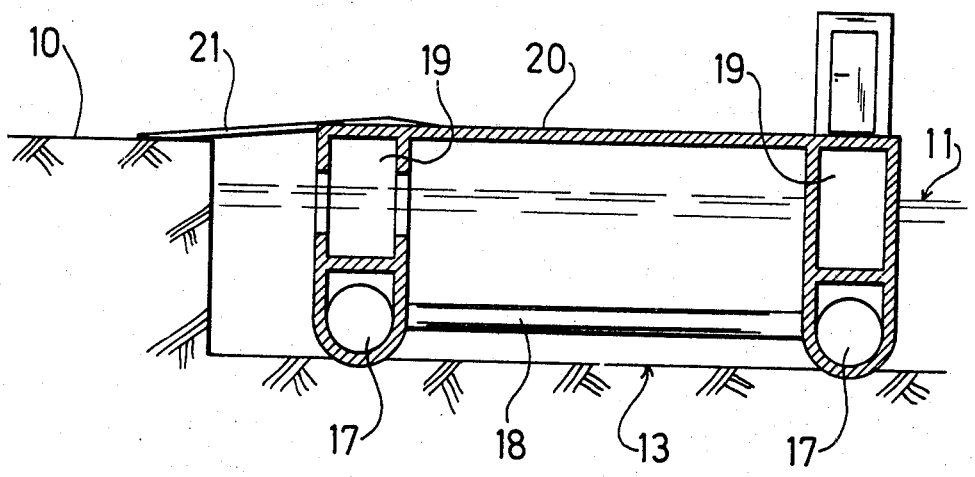
FIG. 3 is a cross section along line III—III in FIG. 1.
Figure 4:
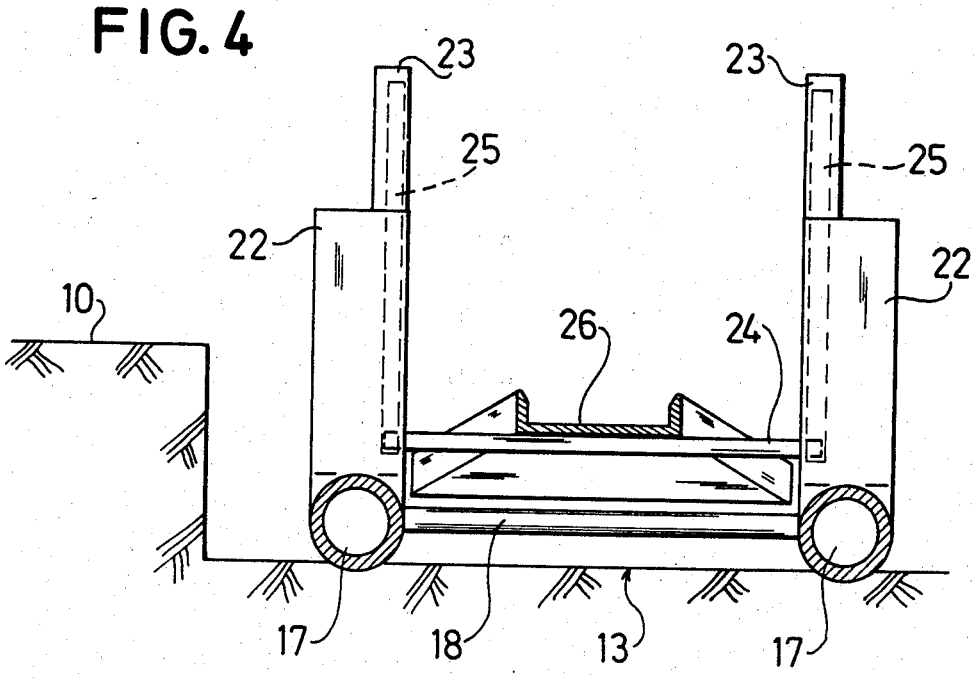
FIG. 4 is a cross section along line IV—IV in FIG. 1.

The caisson structure shown in the drawings is intended for use at a quay 10 in a port, where noticeable variations in tide water level occur.

High water level is denoted by 11 and low water level is denoted by 12. The basic bottom contour is indicated at 13 and a trench 14 has been excavated to an abutment 15.

The caisson structure 16, which shall form an intermediary between a ship (not shown) moored at the quay 10 within the area of the dredged trench 14, comprises two elongate displacement bodies 17, which are subdivided into a suitable number of ballast tanks. These are connected to a pumping machinery (not shown) so it is possible to withdraw sufficient ballast to make the caisson structure floating, whereby it can be moved to an other location, within the same port, or possibly to an other port.

The displacement bodies are located at a mutual distance ensuring a satisfactory transverse stability of the caisson structure and are interconnected by a number of cross stays 18. At one end of the displacement bodies a first housing 19 is provided, which has sufficient height to reach safely above highest tide water level 11, and carries a platform 20, which by a ramp 21 is connectable to the quay 10.

The first housing 19 will preferably contain the ballast pumping machinery and other operating equipment.

A second housing 22 is arranged at the opposite ends of the displacement bodies 17, and comprises two towers 23, which extend higher than platform 20 at the first housing. The towers are interconnected by a transverse beam 24, which is carried by vertically operable mechanisms 25 within towers 23.

A communication ramp 26 extends from platform 20 past towers 23. The main extent of the ramp has sufficient breadth to accommodate vehicles of the size actual for the traffic in question, but is terminated by a broadened portion 27 for cooperation with a ship, or with a ramp thereat. The ramp 26 may be hinged at the platform 20, but can alternatively be arranged so its end at the platform 20 will slide upon the deck thereof during changes in ramp inclination.

The displacement bodies will be strongly united by the two housings, the distance between the bodies exceeding the breadth of the ramp.

The part 28 of the ramp forming the connection with the platform 20 is broadened in the direction of the quay, so it will be easier for a vehicle to turn from the ramp to the quay, or vice versa.

The length of the displacement bodies is selected so that inclination of ramp 26 at different tide water levels will not obstruct the traffic.

The embodiment described above is an example only, and many variations of its components may be made within the scope of the appended claims.

On occasions when it is expected that mooring operations will occur seldom only, it is possible to arrange the ballast pipings for attachment to an external pumping equipment. The aim of the displacement unit is to ensure a satisfactory stability of the structure, i.a. including a sufficient load to withstand action of waves and water currents, so the transport roadway remains undisturbed. The structure may include more than two parallel displacement bodies, and it is of course possible to arrange a series of transverse bodies which are interconnected by longitudinal stays.

A caisson structure according to the invention may find a widespread use and may for instance be used as an independent unit providing communication between a big ship moored adjacent to the caisson and a number of small feeder ships. The caisson structure may also be used as an intermediate station for workshop- and supply ships serving the off-shore industry.

What I claim is:

1. A mobile caisson structure comprising at least one elongate displacement unit having ballast tanks, a first housing at one end of said displacement units, said housing having sufficient height to extend above high water level at the location where the caisson is expected to be used with its displacement unit resting upon the sea bottom, said housing having a platform located above said high water level, a second housing comprising two towers at the opposite end of said displacement unit, a communication ramp having one end supported by the platform of said first housing, and extending at least to said second housing, and means at said second housing for raising and lowering the adjacent end of said communication ramp.

2. The caisson according to claim 1, in which said displacement unit comprises two parallel displacement bodies, which are spaced apart a distance at least corresponding to the breadth of the communication ramp, and which are interconnected by said two housings.

3. The caisson according to claim 1, in which said communication ramp extends past said second housing and is terminated by a portion being noticeably broader than at the extension of said ramp between the two housings.

* * * * *